United States Patent [19]

Reist

[11] Patent Number: 4,467,705

[45] Date of Patent: Aug. 28, 1984

[54] FLUID-ACTUATED DRIVE

[75] Inventor: Walter Reist, Hinwil, Switzerland

[73] Assignee: Feramatic AG, Hinwil, Switzerland

[21] Appl. No.: 338,569

[22] Filed: Jan. 11, 1982

[30] Foreign Application Priority Data

Feb. 10, 1981 [CH] Switzerland ..... 874/81

[51] Int. Cl.[3] ..... F01B 9/00

[52] U.S. Cl. ..... 92/137; 92/165 PR; 92/166

[58] Field of Search ..... 92/137, 165 PR, 165 R, 92/166

[56] References Cited

U.S. PATENT DOCUMENTS

| | | | |
|---|---|---|---|
| 368,016 | 8/1887 | Schrankel | 92/137 |
| 1,772,892 | 8/1930 | Green | 92/137 |
| 3,965,802 | 6/1976 | Jacobs | 92/137 |
| 4,339,921 | 7/1982 | Schanz | 92/165 PR |

FOREIGN PATENT DOCUMENTS

| | | | |
|---|---|---|---|
| 2306630 | 9/1974 | Fed. Rep. of Germany | 92/165 PR |
| 2637290 | 2/1978 | Fed. Rep. of Germany | 92/165 PR |
| 2066700 | 7/1971 | France . | |

*Primary Examiner*—Paul L. Maslouski

*Attorney, Agent, or Firm*—Werner W. Kleeman

[57] ABSTRACT

Within a cylinder of a double-acting piston-and-cylinder unit there is displaceably arranged a piston. A spatially moveable piston rod in the form of a universal or ball pivot-link chain is connected with the piston. The piston rod is lengthwise guided by tensioning or tie bolts internally of the cylinder, these tensioning bolts clamping towards one another both of the cylinder heads and piercingly extending through the cylinder. Externally of the piston-and-cylinder unit the piston rod is guided within a guide tube which is connected with one of the cylinder heads. This guide tube can possess a random spatial extent. At the piston rod there is attached a coupling element with which there can be coupled the object or the like which is to be moved. This coupling element extends through a longitudinal slot provided in the guide tube. The spatial mobility of the piston rod enables guiding the piston rod externally of the piston-and-cylinder unit in a random direction.

12 Claims, 6 Drawing Figures

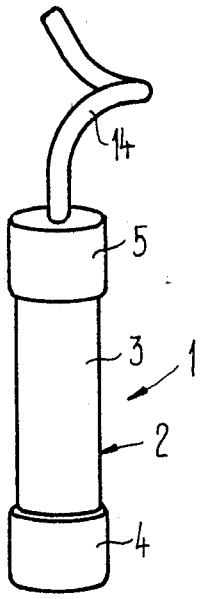
Fig. 1
Fig. 4
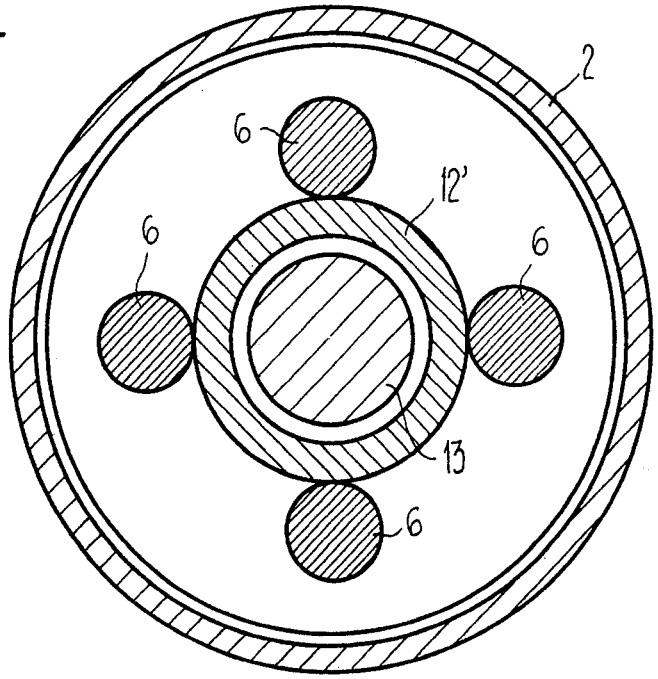

FLUID-ACTUATED DRIVE

BACKGROUND OF THE INVENTION

The present invention relates to a new and improved construction of a fluid-actuated drive arrangement, especially a traction and thrust drive.

Generally speaking, the fluid-operated or fluid-actuated drive of the present development is of the type containing a piston-and-cylinder unit which possesses a piston rod connected with a piston guided for to-and-fro movements within the cylinder. The piston rod transmits the traction and/or thrust or compressive forces.

With state-of-the-art pneumatic or hydraulic drives utilizing a rigid piston rod and the thrusting-out of the piston rod in the extension of the cylinder requires a free space, the length of which corresponds to the length of the stroke of the piston-and-cylinder unit. Significant in this regard are, for instance, German Patent Publication No. 2,842,116 and the cognate U.S. Pat. No. 4,229,134, granted Oct. 21, 1980. The spatial requirements of such type of drives therefore amounts to more than twice the displacement stroke which, in turn, especially in the case of drives working with large strokes results in an appreciable installation length.

There are already known to the art different drives or drive arrangements which work without any rigid piston rod for the purpose of avoiding the previously explained drawbacks.

According to one proposed solution of this type there is totally dispensed with the use of a piston rod. The power transmission between the to-and-fro driven piston and the object to be moved is accomplished by means of a coupling element which is directly connected with the piston and extends outwardly through a slot provided at the cylinder jacket or shell. However, complicated measures must be carried out in order to seal the cylinder along the region of the slot and to preclude the entry of foreign particles or contaminants such as, for intance, dust into the interior of the cylinder. Moreover, this solution is afflicted with the drawback that the movement of the coupling element is limited to the region of the cylinder, and additionally, only can be accomplished along the lengthwise axis of the cylinder. Hence, the movement of the piston cannot be transmitted to a random site located remote from the cylinder without resorting to the use of additional measures.

According to another prior art drive construction, there is used, instead of the piston rod, a cable which can be coupled with the object to be moved. The cable is affixed at opposite sides or faces of the piston at such piston faces and is guided outwardly through the cylinder heads. The power or force transmission from the piston to the object to be moved is accomplished by the portion of the cable which always is under tensile load. While it is indeed possible to appreciably reduce the installation length to the length of the piston-and-cylinder unit and nonetheless to transmit the motion of the piston directly to a random site or location, still there is required a certain constructional and spatial expenditure for guiding the cable from one piston face to the coupling location where the cable is coupled with the object to be moved and from such coupling location back again to the other piston face. Additionally, deflection rolls for the cables as well as seals for sealing the throughpass locations of the cable must be provided at both cylinder heads.

SUMMARY OF THE INVENTION

Therefore, with the foregoing in mind it is a primary object of the present invention to provide a new and improved construction of a fluid-actuated drive which is not afflicted with the aforementioned drawbacks and limitations of the prior art proposals.

Another and more specific object of the present invention aims at providing a new and improved construction of drive of the previously mentioned type which, with a simplier construction and with as small as possible spatial requirements, enables transmitting along the shortest path the piston movements to a random site removed from the piston-and-cylinder unit.

Still a further significant object of the present invention aims at the provision of a new and improved construction of fluid-operated drive, especially a traction and thrust drive, which is relatively simple in construction and design, extremely economical to manufacture, extraordinarily reliable in operation, not readily subject to breakdown or malfunction, and requires a minimum of maintenance and servicing.

Now in order to implement these and still further objects of the invention, which will become more readily apparent as the description proceeds, the fluid-actuated drive of the present development is manifested by the features that the piston rod is spatially moveable and is guided by means of a guide extending in the mobility direction of the piston rod, this guide extending into the cylinder.

Owing to its spatial mobility the piston rod can be randomly spatially guided at a location following the cylinder which, with modest space requirements and without difficulty, enables transmitting the movement along a suitable path to any desired location. The guide extending internally of the cylinder prevents any kinking or bowing-out of the piston rod when it is subjected to pressure or compressive load.

There is preferably used a double-acting piston-and-cylinder unit. This enables exerting a force in both directions of movement of the piston.

If as contemplated by the preferred embodiment of the invention the piston rod is constituted by a universal or ball pivot-link chain, then throughout every spatial guiding of the piston rod there can be faultlessly transmitted both traction as well as also compressive forces.

A particularly simple and compact construction can be realised if the section of the piston rod guide, extending internally of the cylinder, is formed at least over a portion of its length by the bolts or equivalent structure which interconnect the cylinder heads with one another. By placing the bolts which clamp the cylinder heads towards one another and which usually were arranged externally of the cylinder now internally of the cylinder it is possible to assign to such bolts the additional task of linearly guiding the piston rod within the cylinder.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a perspective view of a drive or drive arrangement constructed according to the invention;

FIG. 4 illustrates on an enlarged scale in relation to the showing of FIG. 2 a section taken substantially along the line IV—IV of FIG. 2;

DETAILED DESCRIPTON OF THE PREFERRED EMBODIMENTS

Figure 2:
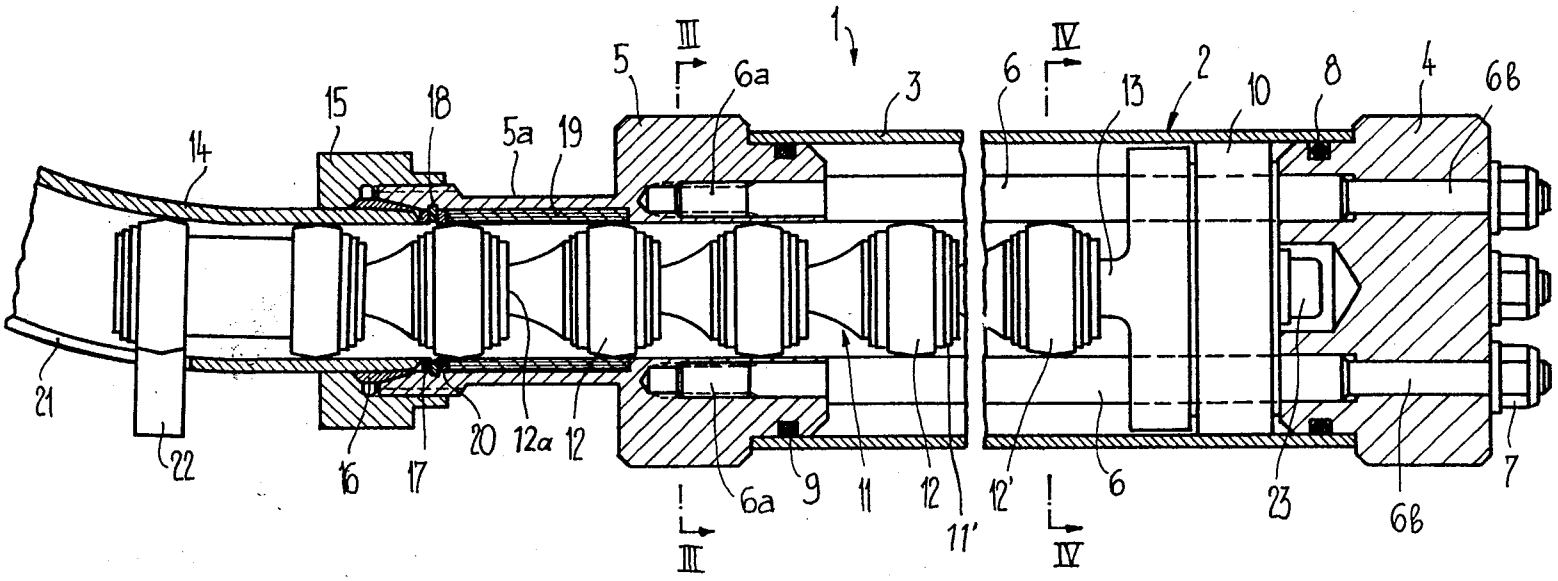
FIG. 2 is a longitudinal sectional view of the drive arrangement shown in FIG. 1, depicted here on an enlarged scale.
Figure 3:
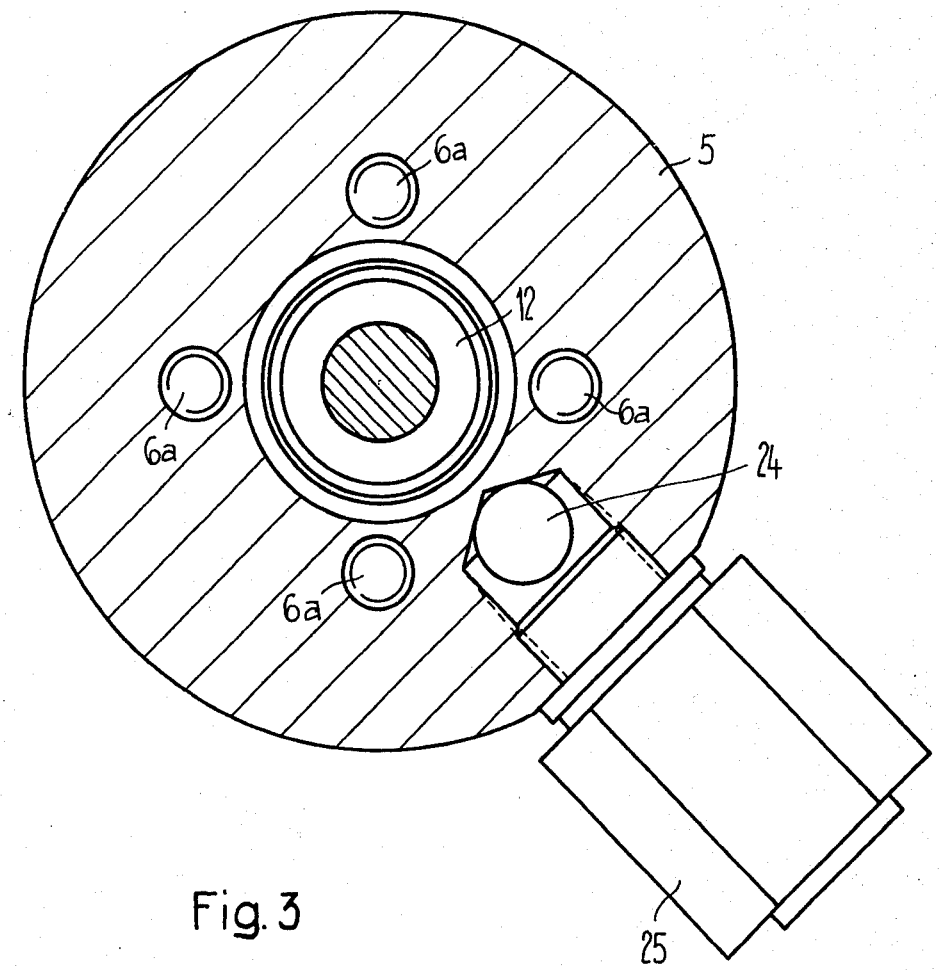
FIG. 3 illustrates on an enlarged scale in relation to the showing of FIG. 2 a sectional view of the arrangement thereof, taken substantially along the line III—III of FIG. 2.

Describing now the drawings, the drive or drive arrangement shown in perspective view in FIGS. 1, 2 and 3 and in different sectional illustrations will be seen to comprise a fluid-operated, here a pneumatic piston-and-cylinder unit 1. However, it should be understood that also there can be employed a hydraulic piston-and-cylinder unit. The cylinder 2 of the piston-and-cylinder unit 1 is formed in conventional manner by a cylinder shell or jacket 3 and two cylinder heads 4 and 5. Both of the cylinder heads 4 and 5 are clamped towards one another by means of the tensioning or tie bolts 6 or equivalent structure. In contrast to heretofore known designs the tensioning or tie bolts 6 extend internally of the cylinder 2. Each tensioning bolt 6 is provided with a threaded portion at its two opposed ends 6*a* and 6*b*. By means of the threaded ends 6*a* the tensioning bolts 6 are threaded into the cylinder head 5. At the opposite ends 6*b* of the tensioning bolts 6, by means of which these bolts 6 piercingly extend through the cylinder head 4, there are threaded nut members 7 by means of which there is accomplished the clamping of the cylinder heads 4 and 5 against the related end of the cylinder 2. Between each cylinder head 4 and 5 and the cylinder shell or jacket 3 there is arranged a respective sealing ring 8 and 9.

A piston or piston member 10 is arranged internally of the cylinder 2 and which can be driven for to-and-fro movements in likewise conventional fashion in the axial direction of the cylinder 2. A flexible spatially moveable piston rod 11 is connected with the piston 10. This piston rod 11 is formed by a ball pivot-link chain 11' which is of conventional construction. Regarding the mode of operation and construction of such ball pivot-link chain 11' reference may be had to German Patent Publication No. 3,121,835 and the copending U.S. application Ser. No. 268,729, filed June 1, 1981 and entitled "Universal Link Chain", now U.S. Pat. No. 4,397,145, granted Aug. 9, 1983, as well as to the German Pat. No. 2,220,259 and the corresponding U.S. Pat. No. 3,757,514, granted Sept. 11, 1973. The individual elements or links 12 of the ball pivot-link chain 11' are interconnected with one another by means of ball pivots or joints, generally indicated by reference character 12*a*, which render possible the explained spatial mobility. The piston rod 11 is provided with a connection element 13 with which there is connected the first element or link 12' of the ball pivot-link chain 11'.

As particularly well recognized by referring to FIGS. 2 and 4, the tensioning bolts 6 are distributively arranged about the circumference of the ball pivot-link chain 11' and thus form a linear guide or guide means for the ball pivot-link chain 11'. Externally of the piston-and-cylinder unit 1 there is accomplished the guiding of the ball pivot-link chain 11' by a guide tube or pipe 14 or equivalent structure which spatially extends in the desired manner which can be randomly selected, as will be evident by referring to FIG. 1. The guide means 6, 14 constituted by the tensioning bolts 6 and the guide tube 14 prevent any undesirable kinking or bowing-out of the ball pivot-link chain 11' and ensure that the ball pivot-link chain 11' can be displaced forwardly and rearwardly along the desired path of movement.

The guide tube 14 is connected with a projection or extension 5*a* of the cylinder head 5 in a manner known as such from the tube or pipe connection art. For this purpose there is screwed on to the extension 5*a* a screw cap or retaining nut 15 which coacts with a conical wedge ring 16. The guide tube 14 bears against the support ring 17 which, in turn, is supported against a securing ring 18, such as a Seeger ring which is inserted into the extension or projection 5*a*. The securing or retaining ring 18 serves for securing the position of a sealing bushing 19 which bears by means of a further support ring 20 at the securing or sealing ring 18.

As illustrated in FIG. 2, the guide tube 14 is equipped with a longitudinal slot 21 extending in its lengthwise direction. Extending through such longitudinal slot 21 is a coupling element 22 which is secured at the front end of the ball pivot-link chain 11'. By means of this coupling element 22 the drive is drivingly connected with the object which is to be moved.

As will be recognized by reverting to FIGS. 2 and 3 each cylinder head 4 and 5 is equipped with an infeed channel 23 and 24, respectively, for the infeed of a pressurized fluid medium which, in the embodiment under discussion, is assumed to be compressed or pressurized air. These infeed channels 23 and 24 are coupled with a suitable connection, such as the connection 25 illustrated in FIG. 3. By means of a suitable switching valve it is possible to connect such connections 25 with a suitable compressed air source.

The mode of operation of the described drive or drive arrangement is as follows:

By impinging the piston 10 with compressed air this piston 10 is moved to-and-fro in conventional manner within the cylinder 2. The ball pivot-link chain 11' forming the piston rod 11 participates in such movement of the piston 10 and is accordingly displaced within the guide tube 14. The movement of the piston 10 is therefore transmitted by means of the coupling element 22 to the object which is to be moved.

This drive has the advantage that the object to be moved can move to-and-fro not only in the extension of the axis of the cylinder 2, but rather can also move along a randomly extending spatial path. Since it is possible because of the spatial mobility of the piston rod 11 to have the guide tube 14 directly outbound in a random direction and immediately following the piston-and-cylinder unit 1, it is possible to reduce the requisite installation or assembly length to a dimension which is only slightly greater than the length of the cylinder 2. Since, as already explained, the course of extent of the guide tube 14 can be chosen to be random in space, as desired, it is equally possible to get around any possible obstructions without any difficulty.

Figure 5:
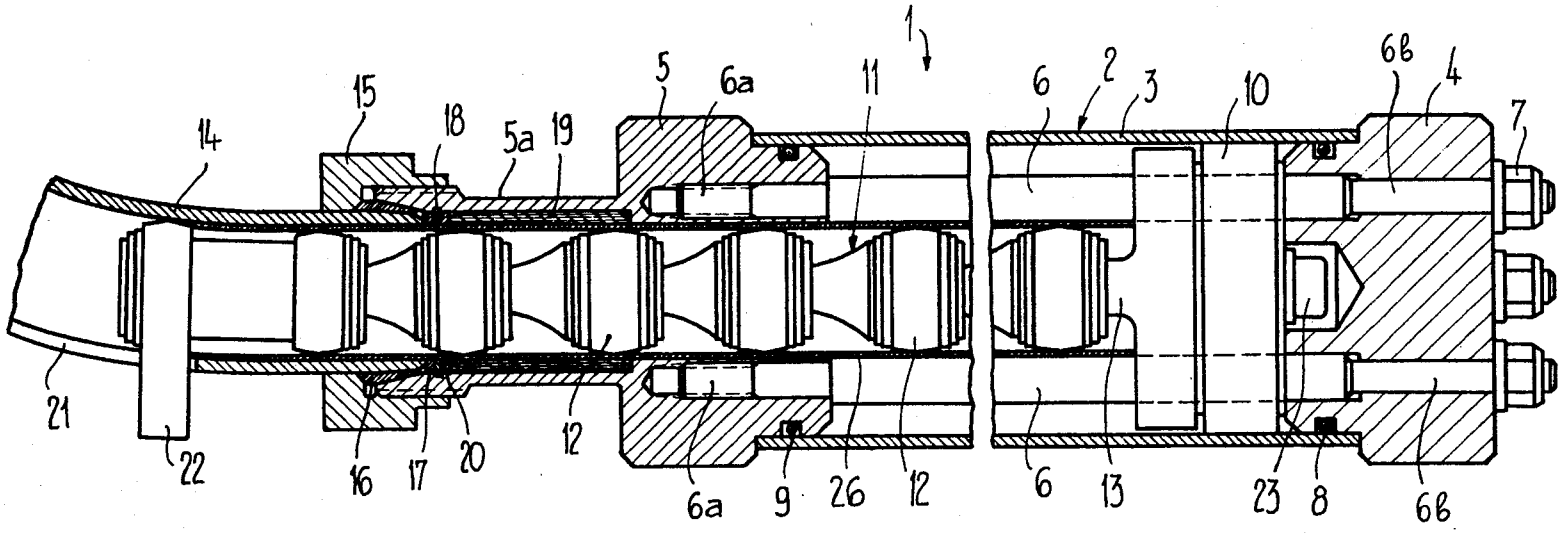
FIG. 5 is a sectional view, analogous to the showing of FIG. 2, of a second embodiment of inventive drive or drive arrangement.
Figure 6:
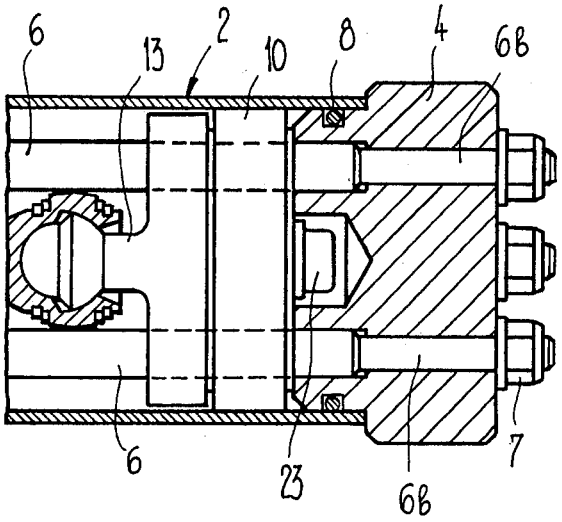
FIG. 6 illustrates in fragmentary sectional view a detail of the arrangement of FIG. 2.

Since with the exemplary illustrated embodiment the longitudinal or lengthwise extending slot 21 in the guide tube 14 extends up to a point close to the piston-and-cylinder unit 1, there exists the danger that foreign particles or contaminants which have penetrated through such longitudinal slot 21 into the interior of the guide tube 14 will move between the chain links or elements 12 and subsequently enter the interior of the cylinder 2. To prevent such penetration of undesired foreign particles or bodies, it is possible for instance to cover such longitudinal slot 21. Moreover it is possible to arrange a flexible, hose-like sleeve member 26 about the ball pivot-link chain 11', as such as been illustrated in FIG. 5. This sleeve member 26 prevents that foreign particles will enter gaps between the chain links or elements 12. In all other respects the variant construction of drive arrangement of FIG. 5 corresponds to the exemplary embodiment of drive discussed above with reference to FIGS. 1 to 4.

Of course, it is possible to construct the spatially mobile piston rod 11 different than herein illustrated and described. Thus, for instance, the piston rod 11 can be constituted by a flexible tube or pipe which may be filled for reinforcement purposes with a gaseous or liquid medium which is under pressure. The piston rod 11 also can be constituted by a flexible rod, for instance formed of suitable plastics materials, a cable, a wire cord or cable or the like. Therefore, the piston rod 11 conceptually may be construed as constituting at least any of these additional modifications or equivalents thereof.

By the use of a double-acting piston-and-cylinder unit 1 it is possible to produce a force in both directions of movement of the piston 10. The drive therefore functions as a thrust and traction drive. However, it is also possible to provide only a single-acting piston-and-cylinder unit, in which case then the resetting of the piston 10 into one terminal or end position must be accomplished by the load coupled with the ball pivot-link chain 11' or by means of any other suitable expedients, for instance by spring force.

The described drive can be used for the most different fields of application. Thus, it is for instance conceivable with such drive to operate flaps and windows and to open and close for instance curtains, such as theatre curtains of circular stages. Moreover, this drive also can be used for moving to-and-fro the ejector element of the stacker equipment described in German Publication No. 2,842,116 and the corresponding U.S. Pat. No. 4,229,134 previously mentioned.

While there are shown and described present preferred embodiments of the invention, it is to be distinctly understood that the invention is not limited thereto, but may be otherwise variously embodied and practiced within the scope of the following claims. Accordingly,

What I claim is:

1. A fluid actuated drive, especially a traction and thrust drive comprising:

a piston-and-cylinder unit comprising a cylinder having opposite ends and a piston arranged for to-and-fro motion within said cylinder along a predetermined piston stroke;

means for closing said cylinder at both of said opposite ends;

a piston rod connected with the piston and serving to transmit predetermined forces;

said piston rod extending through one of the closed ends of said cylinder;

said piston rod being structured to be spatially movable over its entire length;

guide means extending in the direction of movement of said piston rod for guiding said piston rod over its entire length; and said guide means having a first portion arranged outside of said cylinder and a second portion arranged within said cylinder in guiding engagement with said piston rod and extending over the entire length of the piston stroke.

2. The fluid-actuated drive as defined in claim 1, wherein:

said predetermined forces comprise selectively at least any one of traction forces, compressive forces or both.

3. The fluid-actuated drive as defined in claim 1, wherein:

said piston-and-cylinder unit comprises a double-acting piston-and-cylinder unit.

4. The fluid-actuated drive as defined in claim 1 or 3, wherein:

said piston rod is formed by a ball pivot-link chain.

5. The fluid-actuated drive as defined in claim 4, wherein said piston rod includes a flexible sleeve.

6. The fluid actuated drive as defined in claim 1 or 3, wherein:

said piston rod is structured as a flexible element.

7. The fluid-actuated drive as defined in claim 6, wherein:

said flexible element comprises a tube.

8. The fluid-actuated drive as defined in claim 6, wherein:

said flexible element comprises a rod.

9. The fluid-actuated drive as defined in claim 1, wherein:

said cylinder having at opposite ends thereof cylinder heads defining said closing means for closing said opposite ends of said cylinder; and said second portion of said guide means being structured as bolt means interconnecting said cylinder heads with one another.

10. The fluid-actuated drive as defined in claim 1, wherein:

said guide means comprises a guide tube connected with the piston-and-cylinder unit and defining said first portion; and said piston rod being guided externally of said cylinder in said guide tube.

11. The fluid-actuated drive as defined in claim 10, wherein:

said guide tube is provided with at least one longitudinal slot;

a coupling element secured to said piston rod and extending through said longitudinal slot; and said coupling element being capable of being connected with an object which is to be moved.

12. The fluid-actuated drive as defined in claim 1, wherein:

said piston rod which is structured to be spatially moveable over its entire length is moveable in three dimensions.

* * * * *